US006889618B1

(12) United States Patent
Gromack

(10) Patent No.: US 6,889,618 B1
(45) Date of Patent: May 10, 2005

(54) FOLDABLE TABLE

(75) Inventor: Alexander J. Gromack, Congers, NY (US)

(73) Assignee: CSA, Inc., Chester, NY (US)

( * ) Notice: Subject to any disclaimer, the term of this patent is extended or adjusted under 35 U.S.C. 154(b) by 0 days.

(21) Appl. No.: 10/132,825

(22) Filed: Apr. 24, 2002

(51) Int. Cl.[7] ..... A47B 13/02

(52) U.S. Cl. ..... 108/151; 108/50.12; 108/25

(58) Field of Search ..... 108/151, 30, 35, 108/50.12, 14, 25, 27, 162, 166, 167, 171, 108/115, 149; 135/16; 248/156

(56) References Cited

U.S. PATENT DOCUMENTS

| | | | | |
|---|---|---|---|---|
| 1,890,409 | A * | 12/1932 | Roberts | 108/35 |
| 2,190,222 | A * | 2/1940 | Strasser | 248/158 |
| 2,840,092 | A * | 6/1958 | Hill | 135/118 |
| 4,383,487 | A * | 5/1983 | Fitzner et al. | 108/27 |
| 4,461,220 | A * | 7/1984 | Wetzel | 108/30 |
| 5,417,166 | A * | 5/1995 | Credle, Sr. | 108/50.12 |
| 6,347,591 | B1 * | 2/2002 | Karpa et al. | 108/50.11 |

OTHER PUBLICATIONS

Derwent abstract;Au 9230201A;Gonzalez ; Jul. 8, 1993.*

* cited by examiner

*Primary Examiner*—Janet M. Wilkens
(74) *Attorney, Agent, or Firm*—Schmeiser, Olsen & Watts LLP

(57) ABSTRACT

A foldable table adapted to be attached to a center support is disclosed. The table includes two planar sides connected by a hinge. The hinge allows each side to rotate between opened and unopened positions. This allows the table to be maneuvered onto a support structure already in place. A securing device attaches to the table and grips the center support so as to provide support and stability for the assembly, and a leveling device allows the table to be easily placed in a desired orientation. The folded table defines an interior space adapted to carry an umbrella or other elongate support or sheltering structure. Handles may be attached to each side of the table to facilitate its transportation. The table surface may be surrounded by a sidewall which in some embodiments may have notches placed therein to provide additional storage sites for appropriate items. The surface of the table may also include one or more pockets for further storage and with one or more ridges within which additional items may be placed.

6 Claims, 3 Drawing Sheets

FOLDABLE TABLE

BACKGROUND OF THE INVENTION

1. Technical Field

This invention generally relates to a table, and more specifically relates to a foldable, expandable table adapted to be attached to a center support.

2. Background Art

Participants in outdoor leisure activities often desire to have at hand certain personal items such as keys, books, reading glasses, purses, drinks, and so forth in order to enhance the outdoor experience. A table or other convenient spot that is level, clean, and dry is not always readily available, and in many cases it is inconvenient or impractical to transport existing tables to where they are needed or desired. Even where tables or similar surfaces are available they are often dirty, or lack the desired amount of shelter to protect them from the elements. Without a suitable place to store them, personal items such as those listed above may easily be lost, damaged, soiled, or otherwise rendered unfit for use.

Beachgoers, campers, picnickers, and others may find themselves desiring a flat, clean surface that is level, dry, and sheltered from the elements. Portable tables exist but are frequently unsuitable for various reasons. They may be too heavy or too bulky to transport to some areas. They may be unsteady, or it may not be possible to produce a level surface with them, especially when the ground is rough or uneven. They may also be too exposed for certain delicate items that cannot withstand sunlight or rain.

SUMMARY OF THE INVENTION

Therefore, there exists a need for a portable table that can easily be leveled and provided with shelter. The present invention fills that need by providing a foldable table adapted to be attached to a center support. The table comprises two planar sides connected by a hinge. The hinge allows each side to rotate between opened and unopened positions. This motion allows the table to be maneuvered onto a support structure already in place. A securing device attaches to the table and grips the center support so as to provide support and stability for the assembly, and a leveling device allows the table to be easily placed in a desired orientation. The folded table defines an interior space adapted to carry an umbrella or other elongate support or sheltering structure.

In some embodiments of the present invention, handles may be attached to each side of the table to facilitate its transportation. The table surface may be surrounded by a sidewall which in some embodiments may have notches placed therein to provide additional storage sites for appropriate items. The surface of the table may also include one or more pockets for further storage and with one or more ridges within which additional items may be placed.

BRIEF DESCRIPTION OF THE DRAWINGS

The foregoing and other features and advantages of the invention will be apparent from the following more particular description of specific embodiments of the invention, as illustrated in the accompanying drawings, wherein.

It should be noted that the figures are not necessarily drawn to scale, and that elements having similar functions may in some cases be labeled using the same reference numerals.

DETAILED DESCRIPTION OF EMBODIMENTS OF THE INVENTION

The present invention provides a foldable table adapted to be attached to a center support. The table includes two planar sides connected by a hinge. The hinge allows each side to rotate between opened and unopened positions. This motion allows the table to be maneuvered onto a support structure already in place. A securing device attaches to the table and grips the center support so as to provide support and stability for the assembly, and a leveling device allows the table to be easily placed in a desired orientation. The folded table defines an interior space adapted to carry an umbrella or other elongate support or sheltering structure. Handles may be attached to each side of the table to facilitate its transportation. The table surface may be surrounded by a sidewall which in some embodiments may have notches placed therein to provide additional storage sites for appropriate items. The surface of the table may also include one or more pockets for further storage and with one or more ridges within which additional items may be placed.

Figure 1:
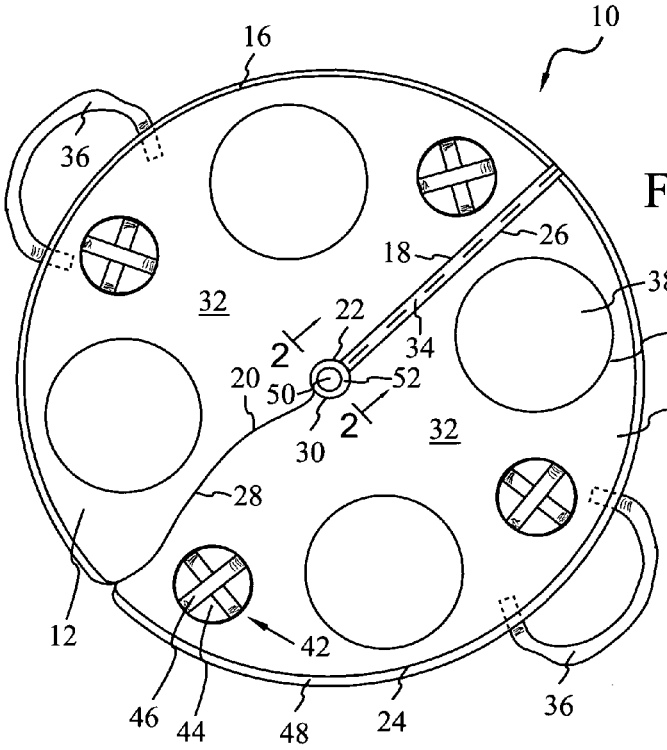
FIG. 1 is a top view of a foldable table configured according to an embodiment of the present invention.

Referring now to the figures, and in particular to FIG. 1, a foldable table 10 has a first planar side 12 and a second planar side 14. First planar side 12 is bounded by a first perimeter 16 comprising a first hinge portion 18, a first channel portion 20, and a first cutout 22 located between first hinge portion 18 and first channel portion 20. Second planar side 14 is bounded by a second perimeter 24 comprising a second hinge portion 26, a second channel portion 28, and a second cutout 30. Second cutout 30 is located between second hinge portion 26 and second channel portion 28. First planar side 12 is hingedly connected to second planar side 14 by a hinge 34. Handles 36 may be attached to first and second planar sides 12 and 14 in order to facilitate the transportation of foldable table 10. In one embodiment, foldable table 10 may be provided with a flat region 38 surrounded by a ridge 40 adapted to confine an item within flat region 38. A pocket 42, comprising an opening 44 and straps 46, may also be provided. Pockets 42 may be adapted to hold cylindrical items such as beverage cans, water bottles, and food containers by giving openings 44 a circular shape. Straps 46 may be replaced in some embodiments by a mesh wall, netting, or other support structure, not shown, adapted to hold in place items inserted in pockets 42. A sidewall 48 may surround foldable table 10 at first and second perimeter 16 and 24.

In one embodiment of the invention, first and second planar sides 12 and 14 are substantially semicircular in shape, giving foldable table 10 a shape that is substantially circular when unfolded. Other embodiments may assume other shapes, such as square or rectangular. Flat regions 38 and pockets 42 may similarly assume a variety of shapes, including circular, square, and rectangular, among others. Sidewall 48, ridges 40, pockets 42, and flat regions 38 function, in part, to provide stability and support for items that are placed on foldable table 10. These and other features allow foldable table 10 to be used in a variety of outdoor locations and activities, such as at the beach or while camping, picnicking, and other activities. The table is adapted to be attached to a center support 50 by a securing device not shown in FIG. 1. Center support 50 may be the pole of a beach umbrella, a tent pole, a tree, a sign post, or any other support capable of supporting foldable table 10 and of fitting into a support opening 52. In at least one embodiment, foldable table 10 is adapted to become a carrier for center support 50, as will be further described in connection with FIG. 6. Support opening 52 is formed by the junction of first cutout 22 and second cutout 30. Support opening 52 may be circular, square, rectangular, and other shapes.

Figure 2:
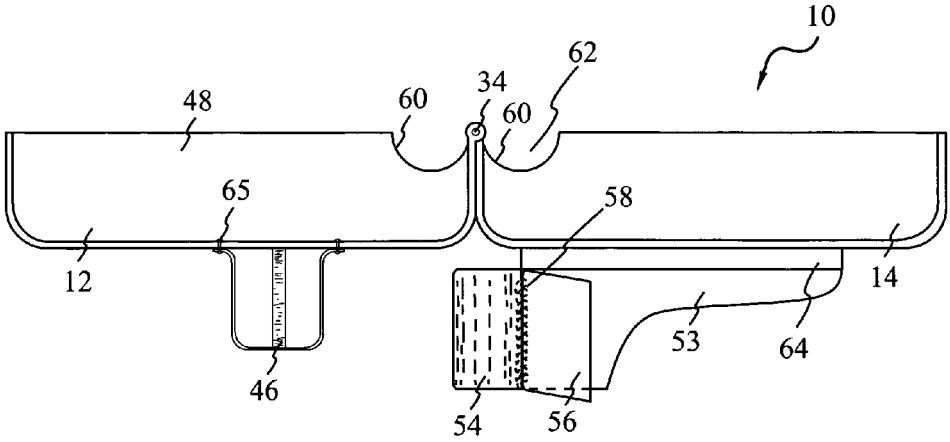
FIG. 2 is a cross sectional view of an embodiment of the foldable table taken at line 2—2 of FIG. 1.

Referring now to FIG. 2, foldable table 10 is shown in cross sectional view and in unfolded position. Straps 46 hang down below first planar side 12 and are held in place by rivets 65. Other attachment mechanisms, such as screws, adhesives, and bolts may be used in place of rivets 65 to attach straps 46 to foldable table 10, as will be apparent to one of ordinary skill in the art. Sidewall 48 is visible at the far extremities of foldable table 10. A channel groove 64 is attached to second planar side 14, and is arranged along a radial line of foldable table 10. A securing device 53 slides into channel groove 64 in a manner that will be more fully described in connection with FIGS. 7 and 8. Securing device 53, in one embodiment, comprises a pair of grips 54, a pair of handles 56, and a spring 58. Securing device 53 is more clearly shown in FIG. 9. Handles 56 may be squeezed to open grips 54 and released to close them, in a conventional manner. Sidewall 48 may be provided with carrying cutouts 60 to form a carrying channel 62 in which center support 50 may be stored and carried. As foldable table 10 is folded about hinge 34, carrying cutouts 60 come together and close about a center support, such as a beach umbrella, not shown, thereby providing a convenient carrying case.

Figure 3:
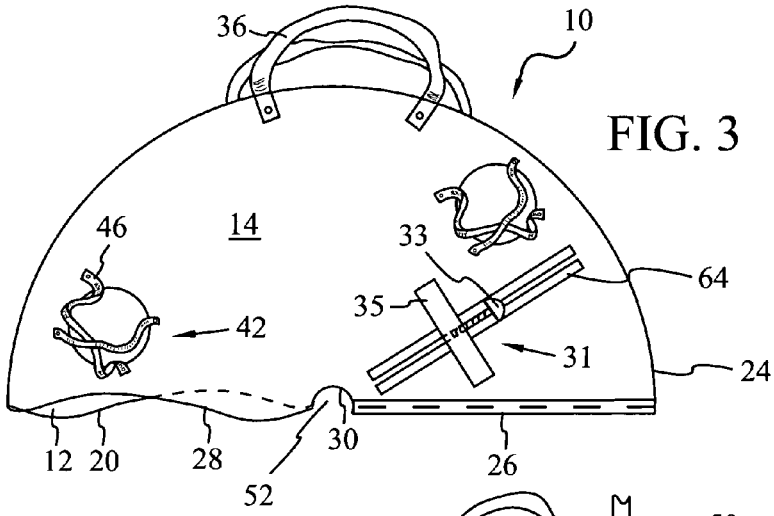
FIG. 3 is a view of side view of an embodiment of the foldable table in a folded position.

In FIG. 3, foldable table 10 is shown in a fully folded position viewed from the perspective of second planar side 14. This view offers another look at second perimeter 24, including second hinge portion 26, second channel portion 28, and second cutout 30. A small part of first planar side 12 can also be seen in this view, including first channel portion 20. Also visible are channel groove 64, pocket 42 with straps 46, and handles 36. A leveling device 31 comprises a screw 33 and a flat attachment 35 adapted to be rotated under foldable table 10. Leveling device 31 brings foldable table 10 into a desired orientation with respect to a chosen reference plane. It will often be desirable to orient foldable table 10 such that it is parallel to some desired reference plane, often the ground in which center support 50 is placed. Leveling device 31 is adapted to make this possible. Other embodiments of leveling device 31 also exist, as will be readily apparent to one of ordinary skill in the art.

Figure 4:
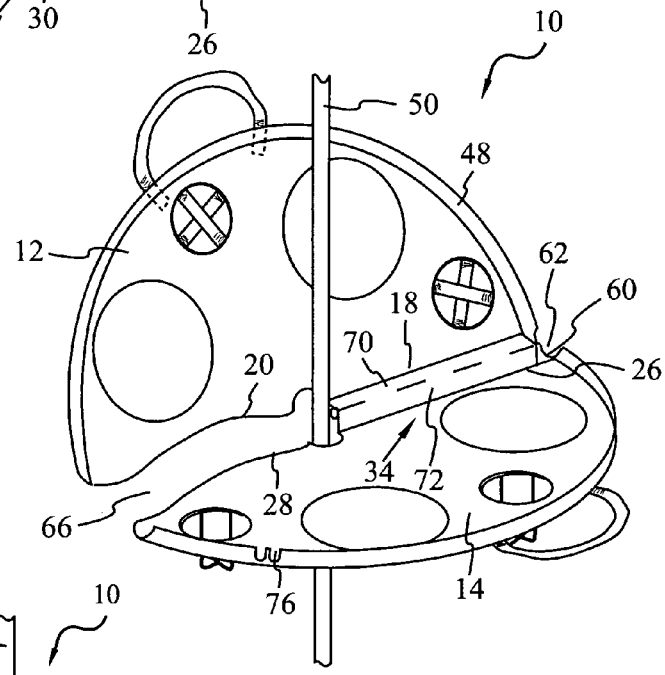
FIG. 4 is a perspective view of the foldable table to indicate how to position the table around a center support.
Figure 4A:
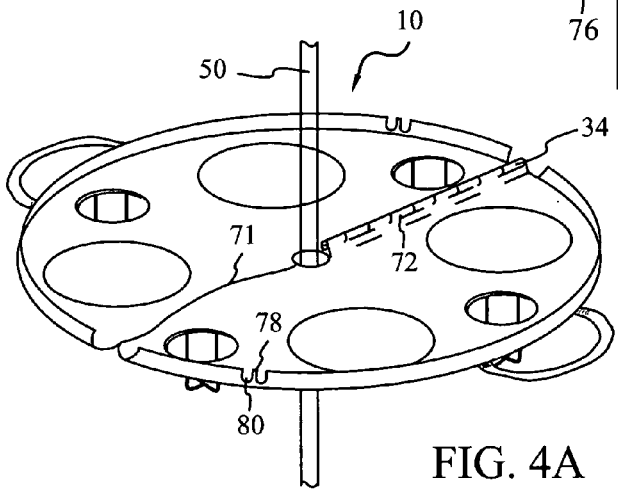
FIG. 4A is a perspective view of an embodiment of the foldable table positioned around a center support.

Referring now to FIGS. 4 and 4A, foldable table 10 is shown being positioned around center support 50. FIG. 4 is a perspective view of foldable table 10 in a partially folded position, meaning foldable table 10 is neither fully folded nor fully unfolded but somewhere in between. In the partially folded position, foldable table 10 reveals a channel 66 that allows foldable table 10 to be slid around and onto center support 50. (FIG. 4A, for example, shows foldable table 10 in the fully unfolded position). Hinge 34 is shown to comprise a first hinge section 70 and a second hinge section 72. In one embodiment, first hinge section 70 is attached to first planar side 12 at first hinge portion 18, and second hinge section 72 is attached to second planar side 14 at second hinge portion 26. When first and second planar sides 12 and 14 of the table begin to fold toward each other about the axis of the hinge 34, as in FIG. 4, channel 66 begins opening to allow center support 50 to be inserted through channel 66, or channel 66 to be moved along center support 50, until channel 66 is between first and second cutouts 22 and 30. Note that carrying cutouts 60 and carrying channel 62 are visible in sidewall 48. Sidewall 48 also contains, in at least one embodiment, notches 76 adapted to hold strapped items such as, for example, a purse, a bag, a CD player, or any other item having a strap. In one embodiment, notch 76 comprises a tab 78 surrounded by two grooves 80. An item with a strap, not shown, may be hung from notch 76 by placing the strap over tab 78 and through grooves 80. If desired, foldable table 10 may be provided with several notches 76. FIG. 4A shows foldable table 10 in a contracted mode positioned around center support 50. Note that in an unfolded position, first channel portion 20 butts against second channel portion 28 to form a centerline 71 of foldable table 10.

Figure 5:
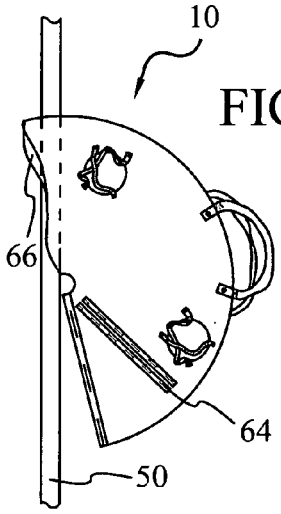
FIG. 5 is a side view of the table being put into place around a center support.
Figure 6:
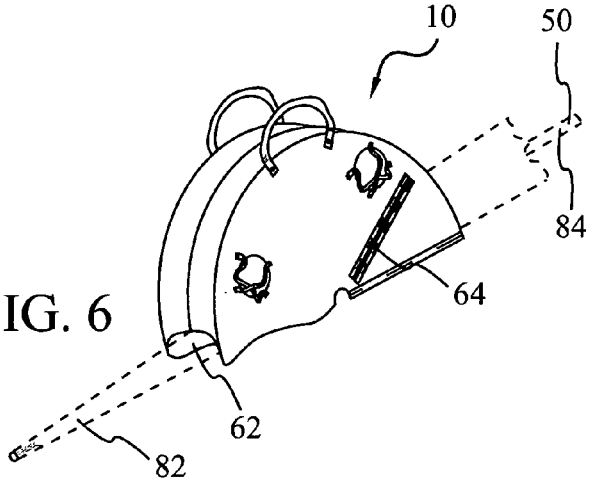
FIG. 6 is a perspective view of the table in folded position carrying a center support.

In FIG. 5, foldable table 10 is depicted from the side in a folded position where center support 50 is able to be inserted into channel 66. Note that because channel 66 opens to receive a middle segment of center support 50 rather than an end, foldable table 10 may be secured to center support 50 even when center support 50 is already in place and where its ends are inaccessible, as in the case of a tall pole having one end buried in the ground and the other end too high to be reachable, or as in the case of a tree, or a beach umbrella already placed in the sand. In FIG. 6, foldable table 10 is again shown in a folded position. Dashed lines outlining the form of a beach umbrella 82 are included to indicate that a beach umbrella or other structure may be placed within carrying channel 62. Beach umbrella 82 has a handle 84 which comprises, in one embodiment of the present invention, center support 50. As was discussed previously, various objects may comprise center support 50, and at least some of these may also be carried within carrying channel 62 inside foldable table 10.

Figure 7:
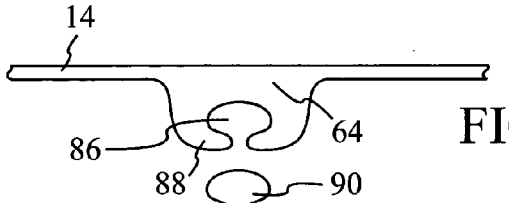
FIG. 7 is a side view of an embodiment of a channel groove attached to a table configured according to the present invention.
Figure 8:
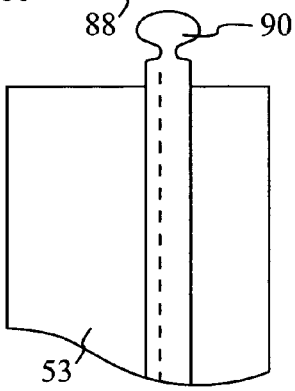
FIG. 8 is a side view of an embodiment of a securing device attached to the table of the present invention.
Figure 9:
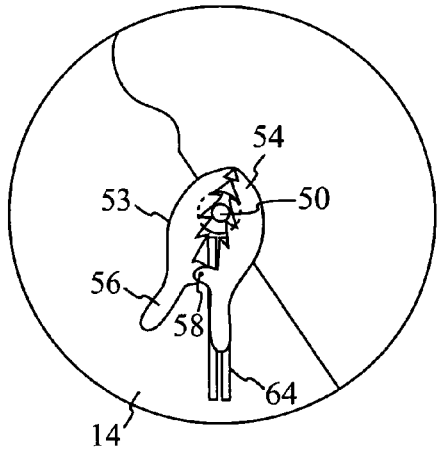
FIG. 9 is a bottom view of the foldable table showing an embodiment of the securing device.

Referring now to FIGS. 7 and 8, channel groove 64 is attached to the bottom of second planar side 14. Channel groove 64 comprises a securing device opening 86 surrounded by a pair of protruding sides 88. A knob 90 attached to securing device 53 is adapted to slide into securing device opening 86. As most clearly shown in FIG. 3, channel groove 64 extends along the bottom of second planar side 14 and approaches support opening 52, from which position securing device 53 may be used to secure foldable table 10 to center support 50 and maintain foldable table 10 in fixed relationship thereto. Note that securing device 53 is removable from foldable table 10. Securing device 53 may in other embodiments take any of a variety of other forms, including other gripping devices, adhering mechanisms, and fasteners. It will be readily apparent to one of ordinary skill in the art that securing device 53 may alternatively be attached to other locations on foldable table 10, including to first planar side 12. FIG. 9 depicts a bottom view of one embodiment of securing device 53 in which grips 54 are rotatable about a spring 58 by manipulating handles 56. Grips 54 grip center support 50, as shown. There are many structures known in the art for quickly and removably clamping or securing one structure to another, any of which may be substituted for the embodiment of a securing device shown herein.

The foregoing description has described selected embodiments of a foldable table adapted to be attached to a center support. As has been described, the table includes two planar sides connected by a hinge. The hinge allows each side to rotate between opened and unopened positions. Partially or fully folding the table allows the table to be maneuvered onto a support structure already in place. A securing device attaches to the table and grips the center support so as to provide support and stability for the assembly, and a leveling device allows the table to be easily placed and supported in a desired orientation. The folded table defines an interior space adapted to carry an umbrella or other elongate support or sheltering structure. Handles may be attached to each side of the table to facilitate its transportation. The table surface may be surrounded by a sidewall which in some embodiments may have notches placed therein to provide additional storage sites for appropriate items. The surface of the table may also include one or more pockets for further storage and with one or more ridges within which additional items may be placed.

In particular embodiments of the invention, the diameter of the unfolded table may be as small as approximately 20 inches, with the sidewall being approximately one or two inches in height. This compact size provides a lightweight table capable of being transported by hand even to remote locations, and of being attached securely to center supports of various descriptions and properties. Larger table sizes are also contemplated for appropriate situations.

While the invention has been particularly shown and described with reference to selected embodiments thereof, it will be readily understood by one of ordinary skill in the art that, as limited only by the appended claims, various changes in form and details may be made therein without departing from the spirit and scope of the invention.

I claim:

1. A foldable table adapted to be attached to a pole extending through its central region, said table comprising:

a first semicircular side bounded by a first perimeter, said first perimeter comprising a first straight portion, a first sinuous portion, and a first semicircular cutout located between said first straight portion and said first sinuous portion, said first semicircular side hingedly connected to a second semicircular side bounded by a second perimeter, said first semicircular side and said second semicircular side together comprising a table surface, said second perimeter comprising a second straight portion, a second sinuous portion, and a second semicircular cutout located between said second straight portion and said second sinuous portion;

a clamp removably attached to a bottom surface of said first semicircular side, said clamp adapted to releasably grip said pole and selectively maintain said table in fixed relationship thereto; and at least one of:

a carrying handle attached to at least one of said first and second perimeter;

a sidewall surrounding a portion of said table surface and oriented substantially perpendicularly thereto, said sidewall comprises a first indentation and a second indentation, said first indentation located opposite said second indentation across said table surface, said indentations adapted to admit the protrusion of portions of an item being carried within said table when said table is in a folded position;

at least one pocket in said table surface; and at least one ridge in said table surface adapted to confine an item therewithin.

2. The invention of claim 1 wherein said hinge connecting said first semicircular side to said second semicircular side is attached to said first semicircular side at said first straight portion and to said second semicircular side at said second straight portion, and wherein said first sinuous portion is adapted to butt against said second sinuous portion when said table is placed in an unfolded position.

3. The invention of claim 1 wherein said first and second semicircular cutouts are symmetrically arranged about a centerline of said table when said table is in an unfolded position.

4. The invention of claim 1 wherein said table further comprises a leveling device adapted to maintain said table surface at a desired orientation when said table is attached to said pole.

5. The invention of claim 4 wherein said leveling device comprises a flat attachment adapted to be rotated under said foldable table with a screw and brings said foldable table in to a level position with respect to a desired reference plane.

6. The invention of claim 1 wherein the sidewall includes at least one notch adapted to hold a strapped item.

* * * * *